United States Patent [19]

Chauvet

[11] Patent Number: 4,551,936

[45] Date of Patent: Nov. 12, 1985

[54] IMPROVED TRIGGER MECHANISM FOR SHOTGUNS HAVING SUPERPOSED BARRELS

[75] Inventor: Pierre Chauvet, St. Etienne, France

[73] Assignee: Societe d'Exploitation Cooperative de la Manufacture d'Armes et Cycles de St. Etienne (S.C.O.P.D. Manufrance), France; a part interest

[21] Appl. No.: 490,980

[22] Filed: May 3, 1983

[30] Foreign Application Priority Data

May 5, 1982 [FR] France ..... 82 08116

[51] Int. Cl.[4] ..... F41C 19/00

[52] U.S. Cl. ..... 42/42 R

[58] Field of Search ..... 42/42 R, 42 A, 41

[56] References Cited

FOREIGN PATENT DOCUMENTS 2455263 11/1980 France .

*Primary Examiner*—Charles T. Jordan

*Assistant Examiner*—Ted L. Parr

*Attorney, Agent, or Firm*—Andrus, Sceales, Starke & Sawall

[57] ABSTRACT

A trigger mechanism for a shotgun with superposed barrels provides certainty in the firing of the second shot from the upper barrel after firing of the first shot from the lower barrel. The trigger mechanism includes a cam engaging the sear for the upper trigger and having an inverted L-shaped opening and a arcuate slot. The cam is biased by the hammer for the lower barrel into a position in which the pins prevent movement of the cam and release of the upper hammer sear. Upon release of the trigger following the firing of the first shot from the lower barrel, a spring biases the cam into a position in which it can be moved by a subsequent action of the trigger to actuate the upper sear to release the hammer for the upper barrel and fire the second shot. The cocking nose of each sear has a circular head co-acting with a complementary notch in the hammer to provide self-centering action in the cocked position.

5 Claims, 5 Drawing Figures

IMPROVED TRIGGER MECHANISM FOR SHOTGUNS HAVING SUPERPOSED BARRELS

The present invention relates to an improved trigger mechanism for shotguns having superposed barrels, said trigger mechanism including safety means.

More specifically, the invention is directed to improving the performance and safety of the trigger mechanism shown in French Pat. No. 2,455,263 issued Nov. 21, 1980 to the present applicant.

The trigger mechanism disclosed in the aforesaid French patent includes an elongated cam pivotally controlled by the rear tail of the hammer for the lower barrel and longitudinally movable with respect to the sear for the upper barrel by a trigger. The cam is urged to the front of the mechanism by a spring. The cam includes an inverted L-shaped or right-angled opening having a pin extending transversely therethrough. The horizontal leg of the right-angled opening enables the cam to pivot about a pivot pin integral with the upper sear to lock the cam upon firing the first shot from the lower barrel of the shot-gun. The vertical leg of the right-angled opening frees the cam for vertical sliding movement for firing the second shot, the rear tail for the lower hammer having been moved out of engagement by the firing of the first shot. The cam may be modified for permitting use of a non-selective single trigger or a double-trigger or a selective single trigger for firing actuation.

According to a first feature of the present invention, the cam has, adjacent its base and along its rear face, an open arcuate slot concentric with the pivot pin of the upper sear. The slot engages a second transverse pin integral with the frame of the trigger mechanism and cooperates, in combination, with the locating of the pin in the horizontal leg of the right-angled opening of the cam so as to provide a double-locking action of the cam. This prevents any accidental release of the hammer for the upper barrel upon the firing of the first shot from the lower barrel.

Another feature of the present invention is that the cam is urged forward by one of the legs of a coil spring centered on a transverse pin integral with the frame, the opposing leg of the spring bearing on the rear portions of the frame.

According to another feature of the present invention, a safety lever for the trigger mechanism has a rounded profile at its base with two heels cooperating with the transverse pin insertable in the open arcuate slot of the cam, so as to insure positive locating of the safety lever in a position in which the firearm is permitted to fire and a positon in which it is prevented from firing.

According to another feature of the present invention, the cocking nose of each sear has a circular head connected at its base with a neck for engagement and centering in a complementary notch of the hammer in order to provide an arcuate range of self-centering hooking in the cocked position.

According to another feature of the present invention, the displacement axis of the hammer rod is located, after cocking, parallel to an imaginary line linking the center of the sear circular head to the pivotal axis of the sear.

Other features and advantages of the present invention will become apparent from the following description with reference to the non-limiting drawings. presently contemplated for carrying out the invention.

Figure 1:
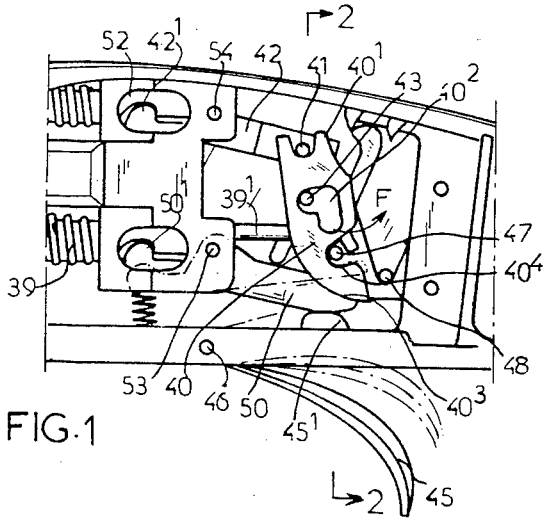
FIG. 1 is a broken away side view of the trigger mechanism of a shot-gun having superposed barrels, the hammers being shown in the cocked position and the movement of certain elements for firing the first shot from the lower barrel being shown in broken lines.

As shown in FIG. 1, hammer 39 of the lower barrel pushingly coacts, by means of rear tail 39$^1$, with a movable elongated cam 40 having a vertical slot 40$^1$ at the upper end thereof to embrace a transversely extending pivot pin 41 secured at the end of upper sear 42 for the upper superposed barrel.

Cam 40 is further provided with an inverted L-shaped or right-angled opening 40$^2$ for sliding engagement with transverse pin 43, integrally connected with the side of frame 44 for the trigger mechanism.

The front lower portion of cam 40 is rounded to present a nose 40$^3$ located opposite the rounded upper face 45$^1$ of the single trigger 45. Trigger 45 is, itself, pivotally mounted in frame 44 by pin 46.

According to the present invention, cam 40 further includes an arcuate slot 40$^4$. Slot 40$^4$ is positioned below right angled opening 40$^2$ and is open to the rear of cam 40. Slot 40$^4$ is concentric with pivot pin 41 so that second transverse pin 47 freely moves in and out of sot 40$^4$ when cam 40 pivots on pin 41. Second transverse pin 47 is integrally formed with the frame 44 for the trigger mechanism.

Support pin 48 is also integrally formed with the frame 44 and is located at the rear of cam 40. Pin 48 is surrounded by the coils of pin spring 49 operating in torsion. One of the legs of 49$^1$ of pin spring permanently bears on the rear face of cam 40, while the other leg abuts the rear of the frame.

According to the foregoing construction, when the device operates on the basis of a non-selective single trigger, it will be readily understood that upon cocking the trigger mechanism, the rear tail 39$^1$ of the lower hammer 39 moves cam 40 rearwardly, as indicated by the arrow F in FIG. 1, about pivot pin 41 against the force exerted by spring 49. Pin 43 engages in the horizontal leg of opening 40$^2$ to provide a double locking to cam 40 against vertical movement.

The double locking insures a more perfect safety, preventing any accidental firing of the second shot in the upper barrel in the case of wear of the right-angled opening 40$^2$ or an incomplete engagement on the horizontal leg thereof. It will be appreciated that, owing to the large radius of slot 40$^4$, the locking action occurs from the start of the rearward movement of cam 40.

Figure 2:
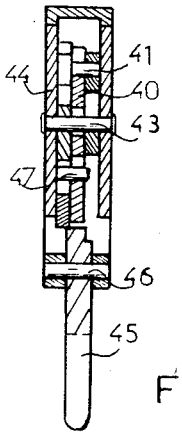
FIG. 2 is a cross sectional view taken along the line 2—2 of FIG. 1.

The mounting of single trigger 45 allows, on the one hand, rocking of the lower sear 50 to release the lower hammer 39 for effecting the firing of the first shot, as illustrated by the broken lines in FIG. 1. The rounded rear upper face $45^1$ of trigger 45 also bears on nose $40^3$ of cam 40, as shown in FIG. 2, so as to retain a cam 40 in the double-locked position in order to prevent accidental firing of the second shot from the upper barrel.

Figure 3:
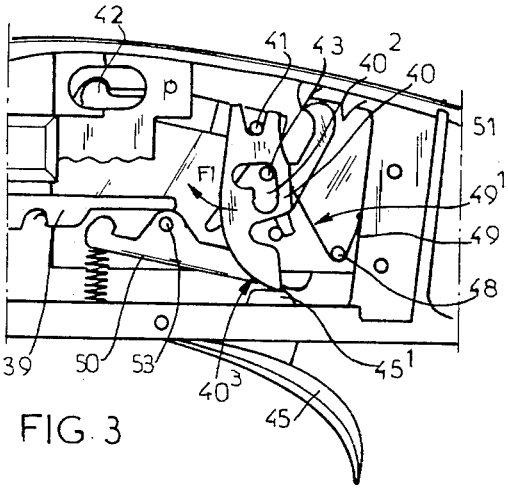
FIG. 3 is a broken away side view similar to FIG. 1 but showing the mechanism after the firing of the first shot from the lower barrel.

When the user releases trigger 45, cam 40 is urged forwardly, as shown by arrow F1 in FIG. 3, by the extension of spring 49 so as to rotate about pivot pin 41. This provides on the one hand, that pin 43 moves to the right angle of opening $40^2$ and, on the other hand, that pin 47 moves out of the bottom of slot $40^4$. The force exerted by a subsequent actuation of trigger 45 through its rear upper portion $45^1$ acting on nose $40^3$ obtains a vertical motion of cam 40 to pivot upper sear 42 and fire the second shot from the upper barrel.

It will be appreciated that the foregoing features are also suitable for use in a two trigger device, for example, that shown in applicant's previous French Pat. No. 2,455,263 either of which operates on the basis of a non-selective double-acting trigger and likewise in the case of a firearm having a single trigger selective for the shot to be fired, and also for a firearm having a conventional independent trigger.

Figure 4:
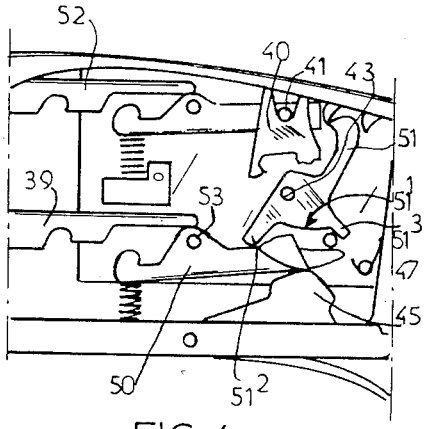
FIG. 4 is a broken away view similar to FIG. 1 showing the condition of the mechanism after the firing of the second shot from the upper barrel and with portions of the elements of the mechanism broken away to more clearly show the action of the elements.
Figure 5:
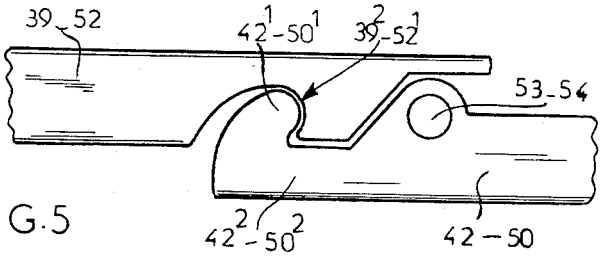
FIG. 5 is a partial side view showing the engagement of one of the hammer-rods with the sear upon cocking the trigger mechanism.

According to the present invention, a safety lever, shown in FIG. 4 is pivotally mounted on pin 43 and located beneath cam 40. Safety lever 51 has, in its base, a rounded sector $51^1$ which is opposite pin 47 and is provided with two spaced heels $51^2$ and $51^3$, respectively, that abuttingly co-act with pin 47 so as to limit the movement of safety lever 51 in both directions between a first position in which the firearm is permitted to fire and a second position in which firing is prevented.

It will also be noted that each sear 42 and 50 has a cocking nose in the shape of rounded head $42^1$–$50^1$ with provision at its rear and base of a neck $42^2$–$50^2$ such that the rounded head forms a projection which is engaged and peripherally centered in a complementary notch $39^2$ and $52^1$ of the corresponding hammer 39 or 52.

It will also be noted that an imaginary line connecting the center of head $42^1$–$50^1$ with the pivot axis 53–54 of each sear 50–42 is situated along the axis of the sliding rod of the corresponding hammer 39–52 so as to provide a self-centering and a perfect engagement.

It will be appreciated that the foregoing arrangement providing a safety in the cocking action of the firearm is suitable for use on other firearms and to those having either sliding or rocking hammers.

It will be further understood that the foregoing description is not limited to the disclosed embodiments and that various modifications can be made without falling outside the scope of the invention as defined by the appended claims.

I claim:

1. In a trigger mechanism for shot guns having superposed barrels, said trigger mechanism including a frame (44), said mechanism having parallel hammers (39,52) for the upper and lower barrels cooperating, upon cocking, with the noses of pivotal sears (42,52), said lower hammer (39) being extended by a rear tail ($39^1$) for acting upon a pivotally and vertically movable cam (40); said cam having an upper end ($40^1$) coacting with a pivot pin (41) on the sear (42) for the upper barrel and a lower end engagable by the trigger ($45^1$) of the shot gun, said cam being pivoted rearwardly (F) about said pivot pin (41) to a first position by coaction with said rear tail ($39^1$) and pivoted forwardly (F1) to a second position by a spring (49) mounted in said frame (44) and bearing on said cam, said cam (40) having a right-angle opening ($40^2$) receiving a first transverse pin (43) mounted in said frame (44), the rearward pivotal movement of said cam (40) moving said transverse pin (43) into the horizontal leg of said right-angle opening ($40^2$) for preventing vertical movement of said cam (40) for blocking firing of the second shot, the forward pivotal movement of said cam by said spring (49) following firing of the first shot and retraction of the rear tail ($39^1$) of said lower hammer moving said transverse pin (43) into alignment with the vertical leg of said right-angle opening ($40^2$) to permit vertical movement of said cam to actuate said upper sear (42) upon subsequent manipulation of said trigger (45) to fire the second shot from the upper barrel; the improvement comprising:

a generally horizontal arcuate sot ($40^4$) in the rear surface of said cam and proximate to said lower end thereof, said slot being concentric with said pivot pin (41) on said upper sear (42); and a second transverse pin (47) integrally mounted in said trigger mechanism frame (44) and insertable in said slot when said cam is in said first position to provide a double locking of said cam in addition to that provided by said first pin (43) and said right-angle opening ($40^2$) against a vertical movement following firing of said first shot to prevent firing of said second shot without a subsequent manipulation of said trigger mechanism, said second transverse pin (47) being freed from said slot when said cam is in said second position to permit firing of said second shot by a subsequent manipulation of the trigger.

2. The improvement according to claim 1 wherein said spring (49) is further defined as a torsionally stressed coil spring having its coils surrounding a transverse pin (48) mounted in said trigger mechanism frame (44), one of the legs ($49^1$) of said spring coacting with the rear surface of said cam (40) and the other leg of said spring being in abutment with the rear of said trigger mechanism frame (44).

3. The improvement according to claim 1 further including a safety lever (51) pivotally mounted on said first transverse pin (43); said safety lever having, at its base, a rounded sector ($51^1$) with two spaced heels ($51^2$ and $51^3$) abutable with said second transverse pin (47) for defining the location of said safety lever (51) in a first stop position permitting firing of said shot gun and a second stop position preventing firing of said shot gun.

4. The improvement according to claim 1 wherein the nose of each of said pivotal sears (42-50) has a rounded head ($42^1$–$50^1$) connected at its base with a neck ($42^2$–$50^2$) for engaging in a complementary notch ($39^2$–$52^1$) of the corresponding hammer (39–52) for providing an arcuate range of engagement that is self-centering in the cocking position.

5. The improvement according to claim 4 wherein the center of each head ($42^1$–$50^2$) and the pivot point (53–54) of each pivotal sear lie in an imaginary line disposed in the sliding axis of the corresponding hammer (39–52).

* * * * *